US011598504B2

(12) United States Patent
Bailey

(10) Patent No.: US 11,598,504 B2
(45) Date of Patent: Mar. 7, 2023

(54) LED OPTICS SYSTEM

(71) Applicant: Autosystems, a division of Magna Exteriors Inc., Belleville (CA)

(72) Inventor: Edward Bailey, Rochester, MI (US)

(73) Assignee: Autosystems, a division of Magna Exteriors, Inc.

( * ) Notice: Subject to any disclaimer, the term of this patent is extended or adjusted under 35 U.S.C. 154(b) by 0 days.

(21) Appl. No.: 17/504,153

(22) Filed: Oct. 18, 2021

(65) Prior Publication Data

US 2022/0120400 A1 Apr. 21, 2022

Related U.S. Application Data

(60) Provisional application No. 63/092,628, filed on Oct. 16, 2020.

(51) Int. Cl.

| | |
|---|---|
| ***F21S 41/141*** | (2018.01) |
| ***F21K 9/68*** | (2016.01) |
| *F21Y 115/10* | (2016.01) |

(52) U.S. Cl.

CPC ..... *F21S 41/141* (2018.01); *F21K 9/68* (2016.08); *F21Y 2115/10* (2016.08)

(58) Field of Classification Search

None

See application file for complete search history.

(56) References Cited

U.S. PATENT DOCUMENTS

| | | | |
|---|---|---|---|
| 9,091,409 | B2 | 7/2015 | Hu et al. |
| 2003/0214812 | A1 | 11/2003 | Bourdelais et al. |
| 2009/0263609 | A1 | 10/2009 | Stocq |
| 2016/0273719 | A1 | 9/2016 | Bohler |
| 2018/0182940 | A1 | 6/2018 | Yamamoto et al. |

OTHER PUBLICATIONS

International Search Report dated Jan. 24, 2022, which issued in the corresponding PCT Patent Application No. PCT/US2021/055480.

*Primary Examiner* — Elmito Breval

(74) *Attorney, Agent, or Firm* — Dority & Manning, P.A.

(57) ABSTRACT

A LED-based lighting assembly uses minimized distance between an LED source and a diffuser to reduce form factor size, and convex optics, elliptical diffusion and lateral recycling to produce from mini- or micro-chip LEDs a uniform geometrical shape for lit-pixel display of information at high definition. A less than one-to-one (1:1) ratio of LED chip distance and vertical distance between chip and diffuser is achieved with desired uniformity of lit-pixel displays. Reduced distance between diffuser and LEDs and an improved optic provide for more dense yet compact configuration of LEDs in lighting components of automobile grilles and emblems and other lit branding or safety devices in commercial and residential applications.

19 Claims, 20 Drawing Sheets

Fig. 2A
(Related Art)
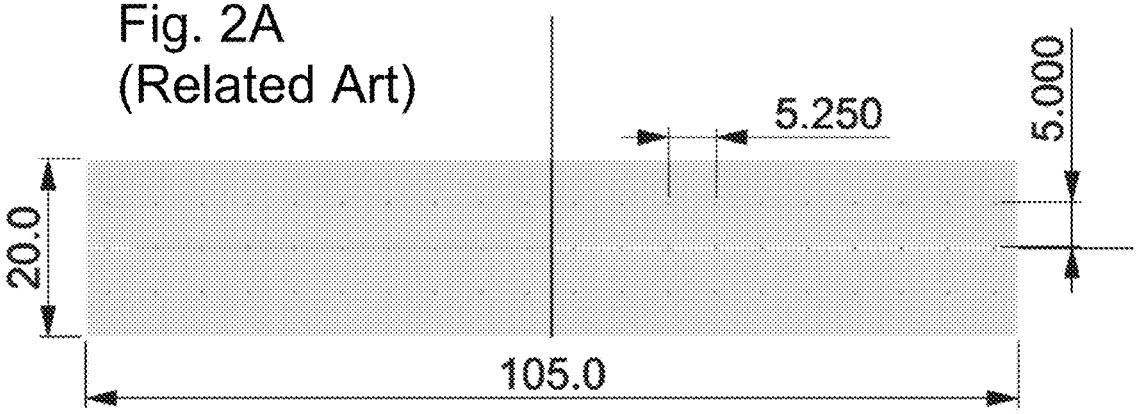
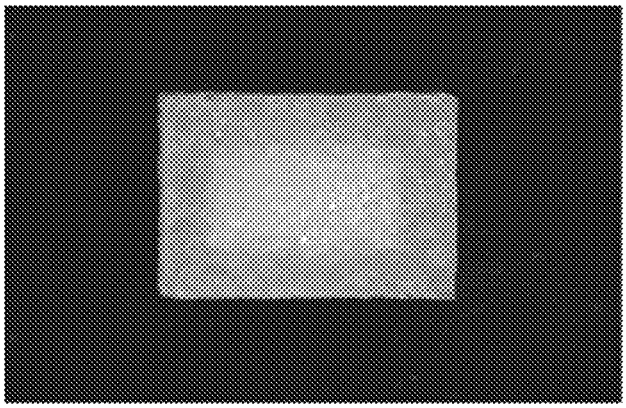
Fig. 2B
(Related Art)
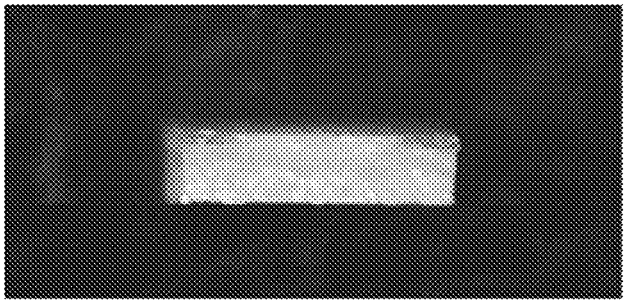
Fig. 2C
(Related Art)
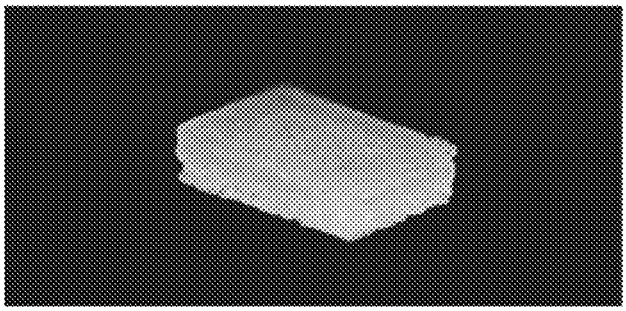
Fig. 2D
(Related Art)

| y-pitch +/- (mm) | lm T | T% | peak intensity (cd) | Beam distribution X/Y |
|---|---|---|---|---|
| 5 | 43.5 | 48% | 25.4 | 70/92 |
| 2.5 | 45.6 | 51% | 29 | 64/92 |
| 1 | 47.2 | 52% | 29.2 | 64/90 |

TABLE 1

FIG. 4

| z dist (mm) | Im T | T% |
|---|---|---|
| 0.5 | 45.6 | 51% |
| 2.5 | 38 | 42% |
| 4.5 | 35.6 | 40% |
| 6.5 | 31.9 | 35% |
| 8.5 | 29 | 32% |

TABLE 2

FIG. 6

| Diffuser (deg) | Illuminance (lux) |
|---|---|
| 5 | 50909 |
| 30 | 45479 |
| 80 | 41387 |

FIG. 8

Fig. 9A
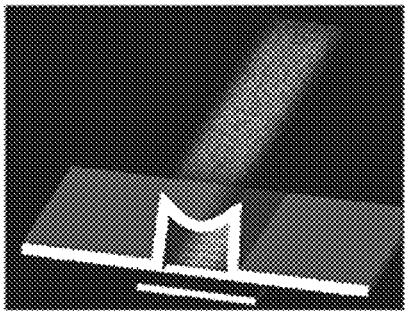
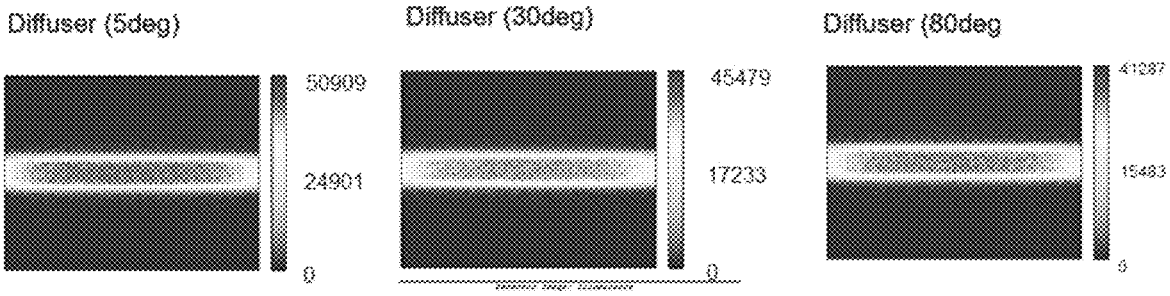
Fig. 9B

Lens exit detector

LED OPTICS SYSTEM

This U.S. Non-Provisional Applications claims the benefit of U.S. Provisional Application Ser. No. 63/092,628, filed Oct. 16, 2020, the entire contents of which are incorporated herein by reference.

TECHNICAL FIELD

The present disclosure relates to a light emitting diode ("LED") and a method of fabricating the same in an LED-based lighting assembly, and more particularly, to a LED-based lighting assembly in a small form factor with improved performance while minimizing power resource requirements and heat concerns.

BACKGROUND

A problem exists regarding manufacturing LED arrays and drivers within small form factors while maintaining performance, efficiency, and minimizing power consumption.

For example, in the case of automobile grilles and emblems, it is desirable to illuminate these components in low-light and no-light conditions for various purposes, including safety and branding. To illuminate these components, a light source must be used that is capable of providing sufficient illumination and being installed behind the components without interfering with the engine compartment. Plus, these components must be capable of being electronically driven or controlled as well as powered in this position.

However, there are design problems associated with manufacturing small form factor micro-LED components.

To electrify micro and mini-chip LED's, one limitation on the size of the pixel is how small the contact spacing in the printed circuit board with copper (Cu) to power the contacts attached to the LED chip. These contacts on the LED chip are used to apply voltage to the PN junction to produce light. In an example existing configuration, for example, the LED chip used is 300×150 micrometers (μm) and can be placed as close as 0.5 millimeters (mm) in pitch from chip to chip.

The distance between LED chips is typically referred to as "pitch." For example, the distance between LED chips in the longer direction is the "x-direction" pitch and the distance between the LED chips in the other direction is the "y-direction" pitch.

Light produced from the LED chip emerges in a distribution pattern which is Lambertian, approximately 120 degrees (deg) full angle distribution at half peak intensity and 140-165 deg field angle distribution at 10% of peak intensity. The 120 deg distribution of the light requires a diffuser positioned a minimal distance from the LED light source to allow for the light to fill in the gaps of light emerging. This distance is typically referred to as the vertical distance or "z-distance".

If a longitudinal cross-section is applied to a light source in which intensity is plotted from chip to chip, then the intensity would be highest directly vertical from the LED chip and lowest at the mid-point between the LEDs.

In typical configurations, for example, diffusers work best when placed a distance equivalent to the LED light source pitch. For example, a 1:1 ratio of y-direction pitch-to-vertical distance yields acceptable uniformity performance as measured by max/min variation <15% constituting 85% uniformity. It is desirable to reduce the overall thickness of the diffusion solution so that the diffuser can be placed closer to the LED without impacting uniformity negatively. To minimize diffuser thickness, back-scatter reflection methods are employed to fill in the light.

As pitch density is increased, the shadow spacing between the LED chips becomes unnoticeable to the naked eye and secondary optical diffusion required is reduced, resulting in higher transmission efficiency. However, as LED chip count increases, the cost goes up as well.

To produce more uniform appearance, it is advantageous to produce geometric elements such as squares and rectangles, which can produce an appearance of larger pixels while using smaller LED chips. With such geometry lighting projection, the production of information display becomes possible in tandem with lighting used for safety such as in automotive and other mobility applications.

Reduced complexity in the secondary diffusion can also reduce the power required to drive the LEDs as lumens transmitted rather than absorbed reduce the adverse thermal effects, which can become a reliability concern.

When lighting devices utilize larger LED packages (e.g., 3×3 mm and 3×5 mm), fewer LEDs are required to produce the required intensity of light, but applying optical transformer devices such as holographic pattern diffusers and volumetric scattering washes out the production of information display (e.g., text, graphics, and control patterns).

It is also advantageous to reduce wide pitch high thermal density devices into a string of light sources to produce a more homogenized appearance, while at the same time not losing the addressability of each LED pixel to work in a combined pattern to produce an information display.

Accordingly, it is desired to minimize pitch and vertical distance to thereby minimize the dimensions of the overall lighting device.

SUMMARY

Example embodiments of the present disclosure resolve these problems by implementing an improved LED in a small form factor with improved performance while minimizing power resource requirements.

To produce a thinner form factor, for example, the present design and technical solution utilizes lateral recycling, convex or concave optics, and elliptical diffusion with high ellipticity ratio to produce from mini-chip LEDs a uniform geometric shape for each lit-pixel that enables display of information with higher definition than previous methods employed with large packaged LEDs. Overall power consumption is thereby reduced by increasing optical efficiency of the lighting system. Further, this design and technical solution results in a more compact structure that saves approximately 60% on z-direction depth.

Traditionally, the package used to house the LED chip establishes the limitations on how small the y-direction pitch can be reduced to improve optical transfer efficiency through a thin optical window. The LED chip on board ("COB") configuration allows for three times (i.e., 3×) closer chip placement in the y-direction. In embodiments of the present disclosure, the limitations caused by the 3×3 mm package used to house a 250-500 μm chip is reduced to the size of the chip light source itself through high speed high precision chip on board placement technology. For example, the chip light source in the example embodiments of the present disclosure is designed to occupy, e.g., 100-350 μm (e.g., mini chips) and 2-100 μm (e.g., micro chips). In addition configurations of micro LED chips with features size <50 μm in which the sapphire or Si substrate is removed either by UV excimer or via grinding etch or polishing may be utilized as light sources. This replacement (i.e., eliminating the standard 3030 or 3.0×3.0 mm package from the design) results in space savings, resulting in a device that is less than 1% the original size (e.g., 0.06 mm^2 or (350×170 μm chip)/9 mm^2=<1%). Otherwise stated, the space savings is over 99%.

In the x-direction (long direction) of a lighting system, the LED chips can be positioned end to end to create uniform lines of light, or with larger gaps to produce more defined pixels which can be flashed, or varied in intensity, to produce wave like lighting effects.

More light can also be transferred through a cover plate (e.g., used to seal and protect the light sources from the environment) when the diffusion surfaces are positioned closer to the light source (i.e. z-direction).

As LED chips are placed closer together in the x-direction, the uniformity from pixel to pixel increases without loss of information display (e.g., ability of lit circuit to display with good definition figures, graphics, and text). Conversely, as x-direction pitch increases, manufacturing cost decreases, but information display capability also decreases.

In the y-direction, the narrowest pitch at 0.5 mm results in the best optical transfer efficiency, whereas undesirable lines or gaps may appear as the y-direction pitch is widened.

For example, as the y-direction pitch is widened, increased pixilation in the appearance becomes a problem. This problem could not be resolved (e.g., it would not be possible to soften and homogenize) with an elliptical diffuser. Rather, for example, a symmetrical diffuser of 30, 60, or 80 degrees can be used to produce smooth appearance; however, this would wash out pictorial geometry of animated features and reduce resolution of dynamic motion in a desired lighting design or pattern.

Controlling diffusion in both the x and y directions is advantageous to the overall system lit appearance to maximize the lit uniformity of geometric or pictographic representations while removing the appearance of the gaps between the lit chips. Diffusion can be controlled, for example by adjusting the distance between the LEDs and the diffuser (i.e., the z-direction distance) and/or adjusting the thickness and material properties of the diffuser. Also, by diffusing only where needed, for example, the lighting device can preserve lettering definition, font edge characteristics, and create more pleasing geometric patterns.

To reduce the large dips in light produced between the hot spots or areas of high illuminance above the LED chip, sufficient z-direction travel in light is necessary before striking the diffusion surfaces (i.e., z-direction distance). Typically, diffusion surfaces are not capable of sufficiently diffusing light directly placed on the chip and require some air gap for light spreading.

If the z-direction distance between light source and diffuser can be reduced, then the uniformity reduces significantly when using packaged LEDs, but with die chip sources and recycling, the 1:1 rule can be improved upon by reducing the thickness of the diffuser by over 60%.

In accordance with an example embodiment, a light emitting diode (LED)-based lighting assembly comprises a light source having a plurality of LED chips chosen from mini-chip LEDs and micro-chip LEDs, wherein an x-direction corresponds to a length of a LED chip, a y-direction corresponds to a width of a LED chip, a z-direction corresponds to a vertical distance from a LED chip, and pitch corresponds to a chip-to-chip distance between two LED chips in one of their x-direction and their y-direction. The plurality of LED chips are arranged at a selected pitch for a designated lighting effect. The LED-based lighting assembly further comprise a diffuser having a diffuser input surface to receive light from the light source and a diffuser output surface to transform received light. The diffuser input surface is disposed a selected distance in the z-direction from light output surfaces of the plurality of LED chips, wherein a less than one-to-one (1:1) ratio exists between the selected pitch and the selected distance. The LED-based lighting assembly also comprises an optic system arranged to receive light from the diffuser output surface and comprising an optical element with convex or concave shape, and a reflector element arranged to reflect and recycle received light.

In accordance with an aspect of an example embodiment, light output from the light source passes through an air gap before impinging on the diffuser input surface.

In accordance with an aspect of an example embodiment, the optical element has a convex-shaped lens input surface and a convex-shaped lens output surface.

In accordance with an aspect of an example embodiment, the diffuser is an elliptical diffuser In accordance with an aspect of an example embodiment, the diffuser output surface comprises a plurality of micro-elliptical elements having different aspect ratios In accordance with an aspect of an example embodiment, the diffuser output surface comprises a plurality of lenslet features of varying heights In accordance with an aspect of an example embodiment, the diffuser output surface comprises microstructures having varying features provided onto a silicone material.

In accordance with an aspect of an example embodiment, the light source comprises a printed circuit board connected to the LED chips to power and control the LEDs, and a silicone coating on at least the light output surfaces of the LED chips.

In accordance with an aspect of an example embodiment, the light source, the diffuser, and the optic system are flexible and curved.

In accordance with an aspect of an example embodiment, the optic element is raised relative to a planar area and the optic system comprises a wall that encloses an optic input surface of the optical element, and the reflector element is disposed adjacent the wall to redirect light output from the diffuser toward the optic input surface.

In accordance with an example embodiment, a method of making a light emitting diode (LED)-based lighting assembly comprises arranging a light source comprising a plurality of LED chips chosen from mini-chip LEDs and micro-chip LEDs to create a selected pattern from the LED chips, wherein an x-direction corresponds to a length of a LED chip, a y-direction corresponds to a width of a LED chip, a z-direction corresponds to a vertical distance from a LED chip, and pitch corresponds to a chip-to-chip distance between two LED chips in one of their x-direction and their y-direction, and wherein the plurality of LED chips are arranged at a selected pitch for a designated lighting effect from the selected pattern. The method further comprises controllably powering the light source using printed circuit board connected to the LED chips to power and control the LEDs, and disposing a diffuser a selected distance relative to the light source, wherein the diffuser has a diffuser input surface to receive light from the light source and a diffuser output surface to transform received light, the diffuser input surface is disposed the selected distance in the z-direction from light output surfaces of the plurality of LED chips, wherein a less than one-to-one (1:1) ratio exists between the selected pitch and the selected distance. The method also comprises arranging an optic system relative to the diffuser output surface to receive light from the diffuser, the optic system having an optical element with convex shape and a reflector element to reflect and recycle received light from the diffuser toward an optic input surface of the optical element.

In accordance with an aspect of an example embodiment, the method of making the LED-based lighting assembly further comprises providing a silicone coating on at least the light output surfaces of the LED chips.

In accordance with an aspect of an example embodiment, the method of making the LED-based lighting assembly further comprises providing microstructures having varying features on the diffuser output surface.

In accordance with an aspect of an example embodiment, the light source, the diffuser, and the optic system are flexible, and the selected pattern comprises a curve, and further comprising arranging the LED-based lighting assembly into the curved selected pattern.

In accordance with an aspect of an example embodiment, the light source, the diffuser, and the optic system are flexible, and further comprising arranging the LED-based lighting assembly into a contoured shape that accommodates a selected mounting structure.

It will be appreciated that any of the above aspects can be combined with each other in different combinations in accordance with example embodiments of the present disclosure.

It is understood that the foregoing general description and the following detailed description are both illustrative and intended to provide further explanation of the subject matter as claimed.

BRIEF DESCRIPTION OF DRAWINGS

The accompanying drawings constitute a part of this specification and illustrate embodiments that, together with the specification, explain the subject matter.

FIGS. 2A, 2B, 2C and 2D illustrate one example of an LED layout of a conventional illumination system including a COB LED system.

FIGS. 4 and 5 illustrate exemplary performances of an LED device as y-direction pitch is decreased.

FIGS. 6 and 7 illustrate exemplary performances of an LED device as z-direction distance is decreased.

FIGS. 8 and 9A and 9B illustrate examples of illuminance at different diffuser angles.

DETAILED DESCRIPTION

The following detailed description is provided with reference to the figures. Exemplary embodiments are described to illustrate the disclosure, not to limit its scope, which is defined by the claims. Those of ordinary skill in the art will recognize equivalent variations in the description that follows without departing from the scope and spirit of the disclosure.

Figure 1:
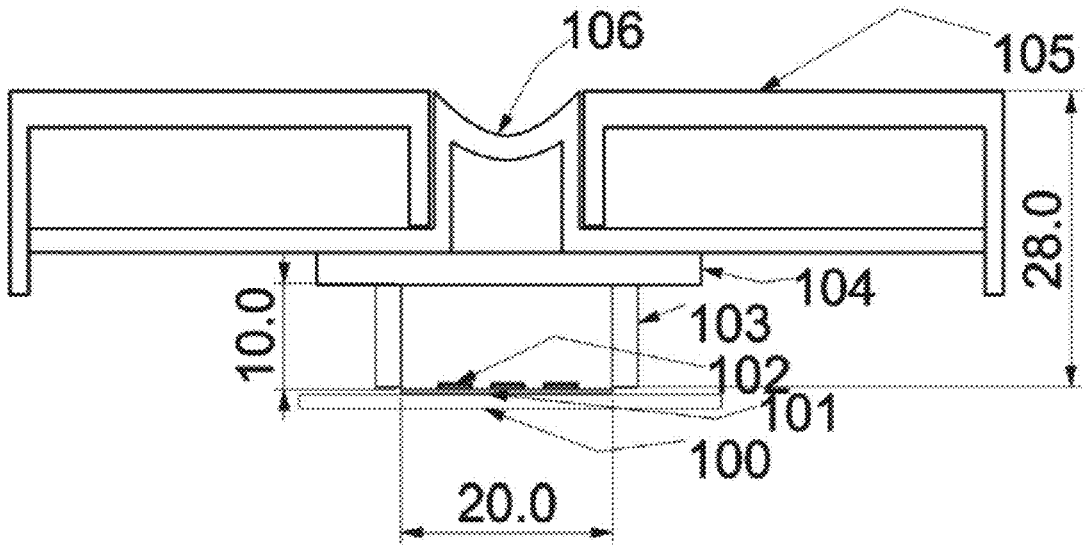
Fig. 1 (Related Art)
FIG. 1 illustrates one example of a conventional illumination system including a Chip on Board ("COB") LED system

FIGS. 1 through 3 illustrate one example of a conventional illumination system including a Chip on Board ("COB") LED system characterized by unsatisfactory performance that can be improved by one or more aspects example embodiments of the technical solution of the present disclosure described in connection with FIGS. 13 through 18. The dimensions shown in FIGS. 1 through 3 are in millimeters (mm), for example. FIGS. 4 through 12B illustrate impacts on performance of the example conventional illumination system of FIGS. 1 through 3 by changes in pitch of LED chips and in the diffuser.

As shown in FIG. 1, the system comprises a heat spreader 100 (e.g., heat dissipation plate, heat sink, etc.). The heat spreader 100 comprises material (e.g., quality, smooth-surfaced, thermal interface materials) with a high heat dissipation efficiency designed to dissipate heat generated by the LED.

Figure 3A:
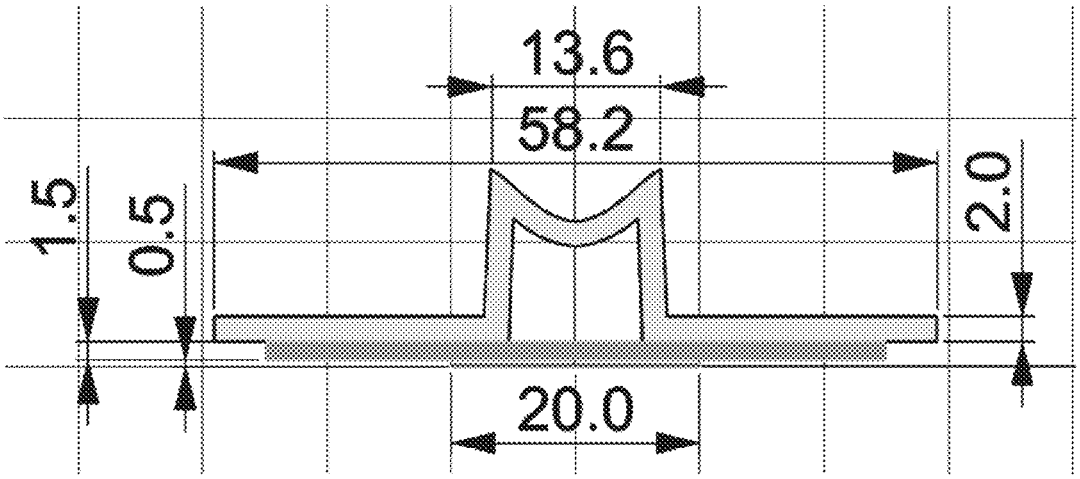
Fig. 3A (Related Art)
FIGS. 3A and 3B illustrate one example of a layout of a conventional illumination system including a COB LED system.
Figure 3B:
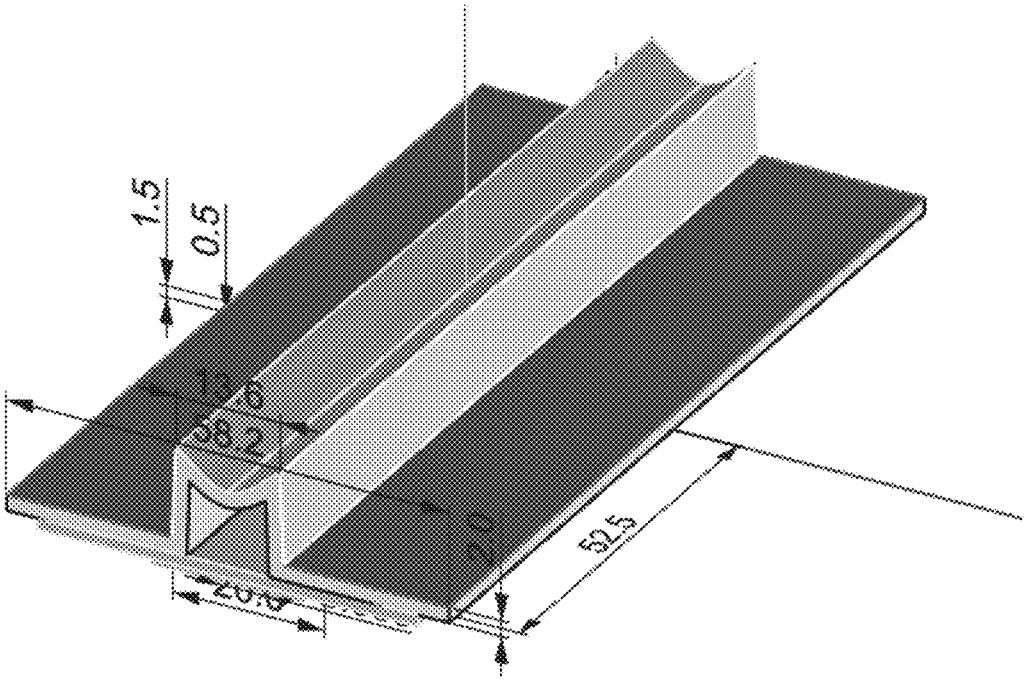
Fig. 3B (Related Art)
Figure 5:
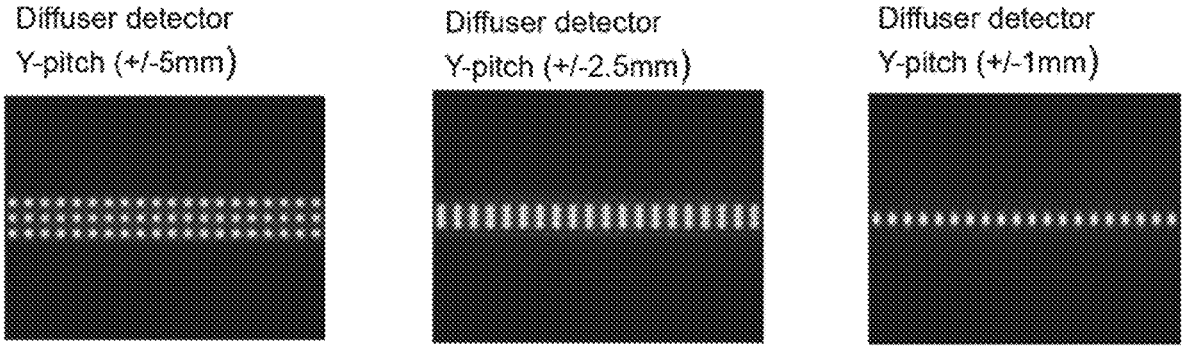

The system also comprises one or a plurality of packaged LEDs 102 mounted on Printed Circuit Board ("PCB") 101. The LEDs 102 may be standard commercially available LED packages such as a 3030 packaged LED. The PCB 101 may be a standard PCB and may be manufactured from FR4, IMS, glass, or other similar components. FIG. 1 shows three of the LEDs 102 arranged in a 3×20 array of LEDs shown in FIG. 2A. FIGS. 3A and 3B illustrate the lens 106 and the diffuser 104 used in connection with the 3×20 array of LEDs shown in FIG. 2A, but with the PCB 101 and the LEDs 102 removed for clarity.

Vertical reflectors 103 are oriented generally perpendicular to PCB 101 and designed to reflect light emitted from the LEDs 102 in a manner designed to (i) prevent light from escaping in a horizontal direction and (ii) permit light to be directed upward and away from the LEDs 102.

Light diffuser 104 is positioned generally parallel to the PCB 101 and above the LEDs 102 and designed to diffuse light emitted from the LEDs 102. As discussed above, the light emitted from a LED must be diffused for the device to emit uniform light. In a typical device, the light diffuser 104 is spaced approximately 10 mm from the LED source 102 which increases form factor undesirably for many lighting applications.

Typically, the geometry of light diffusers 104 include symmetrical micro valleys and hills of 20-250 μm in which the cross-section of an individual lenslet microstructure could be revolved around the centroid axis. The height and width of the lenslet microstructure primitive may be randomized, for example, to remove caustic formation.

When light diffusers 104 are pulled further away from the LED light source 102, geometric resolution begins to wash out as angles of light begin to blend and skew rays mesh together. For example, light emerging from one pixel group merges with light emerging from an adjacent pixel group which may result in geometric and pictorial definition essentially becoming indiscernible. Decorative housing 105 is a decorative housing to the device. For example, in an automotive grille application, the lit grille piece may be translucent, chrome plated or gloss black.

Optical lens 106 is a concave optical lens designed to spread incoming light in one general direction. Depending on the design, the overall thickness of the optical lens 106 may exceed 1" (28 mm) at certain positions.

In typical layouts, the system employs an LED light source 5-sided conformal phosphor chip having such specifications as 1.5-20 lm/LED, 3.5 mA, 10 mW, 5500K, with an x-direction pitch of 5.25 mm, a y-direction pitch of +/−5.0 mm, a 10 mm z-distance between the diffuser 104 and light source 102, and three rows of 20 columns of LEDs 102, as shown in FIG. 2A. The large z-direction distance (shown in FIG. 1) and wider y-direction direction pitch results in poor efficiency and peak intensity. FIGS. 2A through 2D illustrate, respectively, an example view with the x- and y-direction dimensions indicated, a top view, a side view and a perspective side view of an arrangement of LED chips that can be cumbersome in form factor as well as operate with poor performance.

To overcome the problems of the typical system, the present disclosure describes an improved LED-based lighting assembly in accordance with embodiments shown in FIGS. 13-18 that is configured to obtain optical efficiency by reducing the x-direction pitch, y-direction pitch, and z-direction distance, which thereby reduces the minimum required form factor while maintaining optimum performance and efficiency.

Examples of how reduced x- or y-direction pitch and/or z-direction distance can impact performance will now be described with reference to FIGS. 4 through 12B. With regard to the y-direction pitch, as shown in Table 1 (FIG. 4) below and FIG. 5, optimal efficiency improves as the y-direction pitch is reduced from the +/−5.0 mm dimension shown in the example typical system of FIGS. 1 through 3. Specifically, beam distribution and peak intensity are improved. The below depicts system optical efficiency versus y-direction pitch (mm) at 0.5 mm (z-direction distance) from conformal coating of LED with 5 deg diffuser texture (e.g., leading edge—facing LED).

TABLE 1

| y-pitch +/− (mm) | Lumens Transmitted | T % | Peak Intensity (cd) | Beam distribution X/Y |
|---|---|---|---|---|
| 5 | 43.5 | 48% | 25.4 | 70/92 |
| 2.5 | 45.6 | 51% | 29 | 64/92 |
| 1 | 47.2 | 52% | 29.2 | 64/90 |

Lumens transmitted represents the light which has successfully emerged from the light source 102 after passing through the diffuser 104, the recycler walls 103, and the outer concave lens 106. For this example, 90 lm are produced at the light source 102 as a part of a small section of the device (e.g., a lit grille application).

T % represents the light which has successfully passed through the secondary optics including the elliptical diffuser 104, the lens reflector recycler 103 and the outer concave lens 106. For example, at a y-direction pitch of +/2.5 mm, the T % is a ratio of the lumens transmitted (45.6 lm) and the lumens produced at the LED light source (90.0 lm) which is 45.6/90 or 51%. Efficiency of transmitted light increases as the y-direction pitch is decreased.

Beam distribution X/Y represents the full width half maximum of the distribution of the light in the x-direction and the y-direction in which the x-direction is along the longer L dimension of the bar of light, and the y-direction is transverse to the longer dimension. The light which emerges can be changed to be stronger in one direction than the other depending ultimately on the elliptic orientation and strength of the diffuser used.

Depending on the desired system performance, different y-pitch may be employed. For example, if single and more intensity points of light are desired, then the system may be designed at +/−1 mm. Conversely, if more controllable points of light are desired, such as for depicting messages or more complex designs, then y-direction pitch of +/−2.5 mm may be employed.

Figure 7:
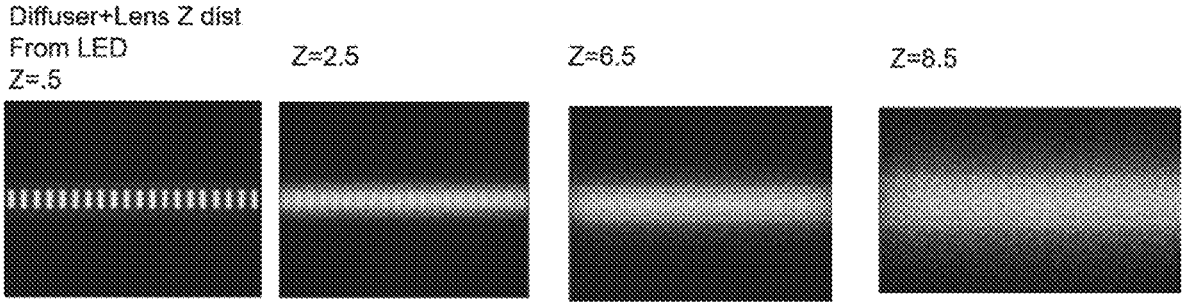

Similarly, system optical efficiency increases with diminished z-direction distance (i.e., the distance between the LED 102 and the diffuser 104). For example, as shown in Table 2 (FIG. 6), a constant y-direction pitch of +/−2.5 mm produced the following results based on adjusting z-direction distance. Conversely, as shown in FIG. 7, as the z-direction distance increases, the uniformity and peak intensity decreases.

TABLE 2

| z-dist (mm) | lumens T | T % |
|---|---|---|
| 0.5 | 45.6 | 51% |
| 2.5 | 38 | 42% |
| 4.5 | 35.6 | 40% |
| 6.5 | 31.9 | 35% |
| 8.5 | 29 | 32% |

Thus, the illumination appearance uniformity improves at the cost of reduced system optical efficiency with increased diffusion.

Figure 10:
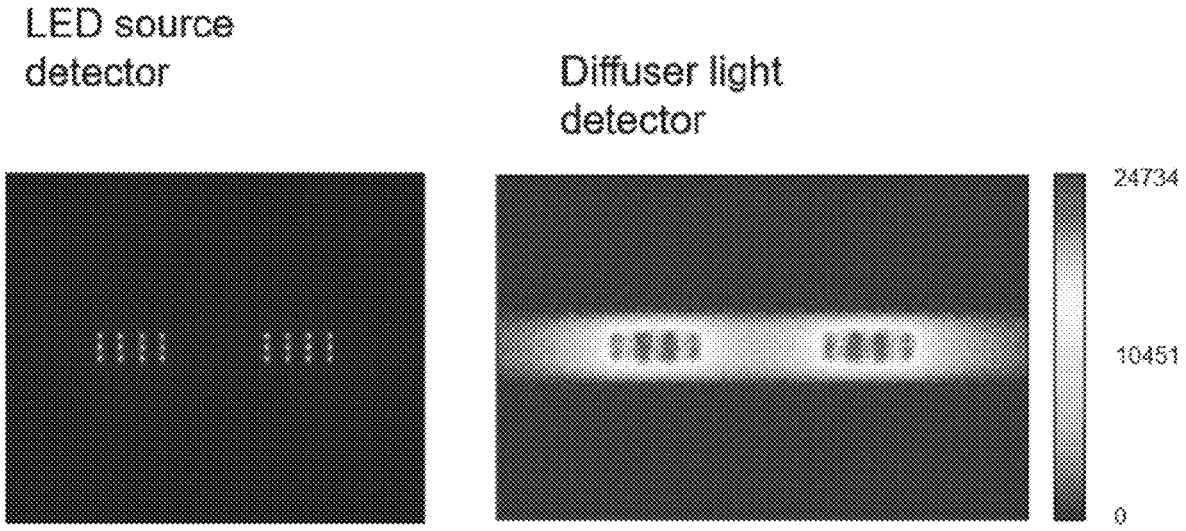
FIGS. 10, 11A, 11B, 12A and 12B illustrate exemplary performances of an LED device as x-pitch is reduced.
Figure 11A:
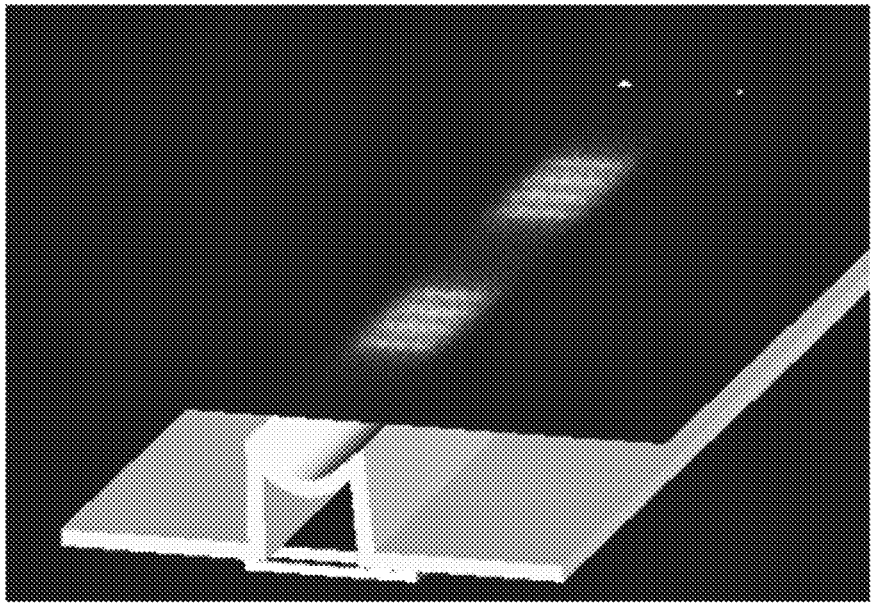
Figure 11B:
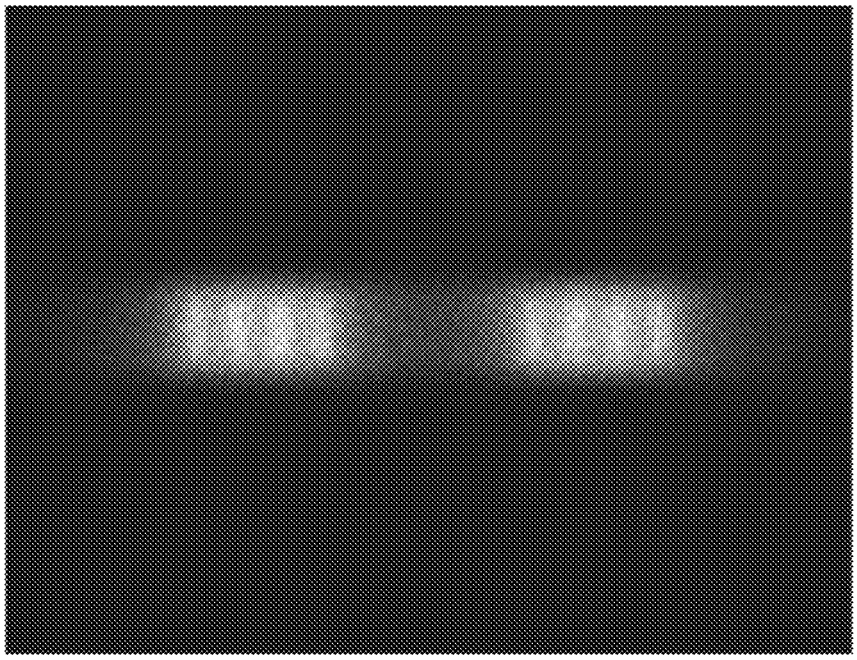

Further, reduced x-direction pitch preserves light columns. As shown in FIGS. 10 and 11A and 11B, decreasing the x-direction pitch in a bank of 12 LEDS (each on/off), with y-direction pitch of +/−2.5 mm, and z-direction distance of 0.5 mm, and diffuser (x/y) at 1×60 deg, results in preserved light columns.

Figure 12A:
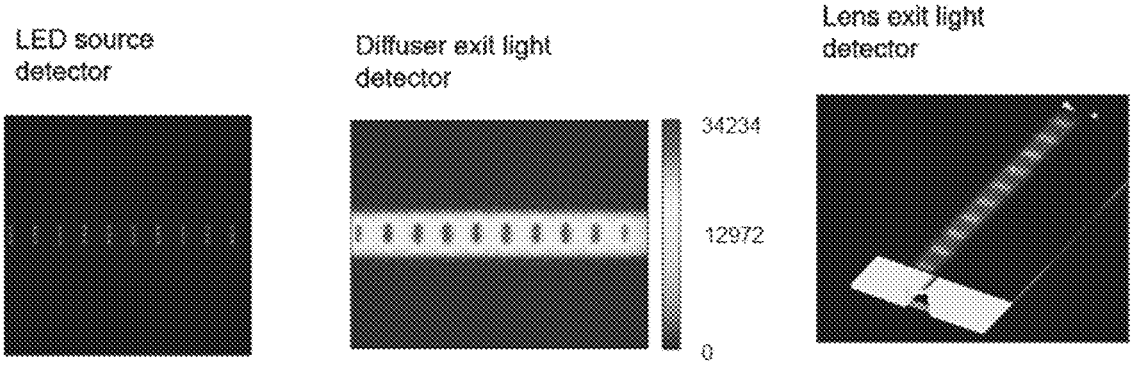

As shown in FIG. 12A, reduced x-direction pitch has the following advantages: (1) preserves light columns, and (2) can be used with zonal dimming to create sequential bars effect. As shown in FIG. 12A with one zone of 3-LEDs (each 50% on/off), y-direction pitch is +/−2.5 mm, z-direction distance is 0.5 mm, and diffuser (x/y) is 1×60 deg.

Figure 12B:
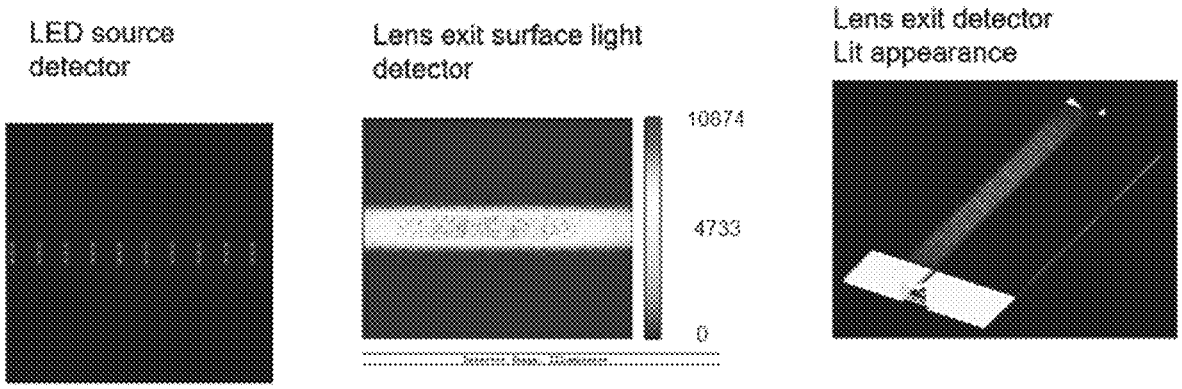
Figure 13:
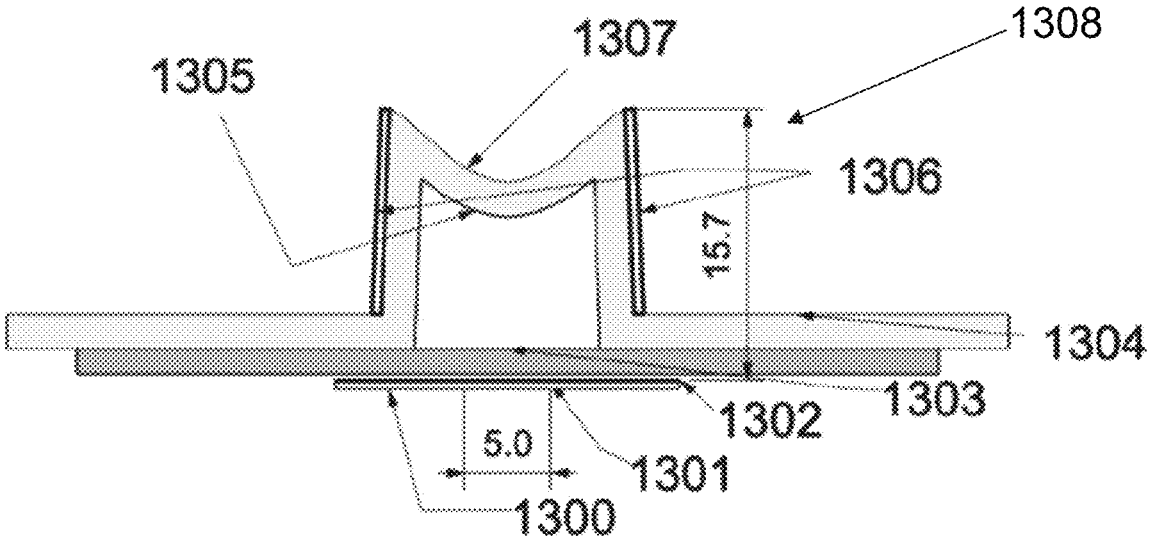
FIG. 13 illustrates an exemplary layout of an example embodiment of the present disclosure.

Conversely, as shown in FIG. 12B, strong x-direction pitch washes out light columns and reduces efficiency by approximately 20%. FIG. 13 illustrates one zone of 3-LED (each 50% on/off), with y-direction pitch at +/−2.5 mm, z-direction distance at 0.5 mm, and diffuser (x/y) at 1×60 deg.

FIG. 13 illustrates an example embodiment of the present disclosure. LED PCB 1300 is the LED PCB used to electrify the LED chips indicated generally at 1301. In accordance with an aspect of example embodiments, the LED chips are LED mini chips 1301 that are spaced in 3 rows at 0,0 (x,y), and +/−2.5 mm.

Silicone coating 1302 is a silicone conformal coating to help extract light from the LED chips 1301 and protect the conformal coating and chips from outside environment.

Diffuser 1303 is an elliptical diffuser placed within 0.5 mm z-direction distance of the LED mini chips 1301, for example.

Surface 1304 is a representation of the planar outer surfaces of the optical lens 1308 and absorbs light.

Incident surface 1305 is the incident surface of the concave portion of the lens system 1308. Reflectors 1306 are reflectors attached directly to the outer walls of the optical lens 1308 to recycle incoming light and to improve uniformity. The reflectors 106 may be applied directly to the outer side surfaces of the optical lens 1308 or the inner surface of the decorative housing (not shown). Direct attachment to the optical lens 1308 without an air gap is preferable for highest recycling efficiency. Outer surface 1307 is the outer surface of the concave optic and it has micro-texture to help homogenize the light.

The space saving in the z-direction as per FIG. 13 is 15.7 mm versus 28 mm in FIG. 1 or 56%.

Figure 14:
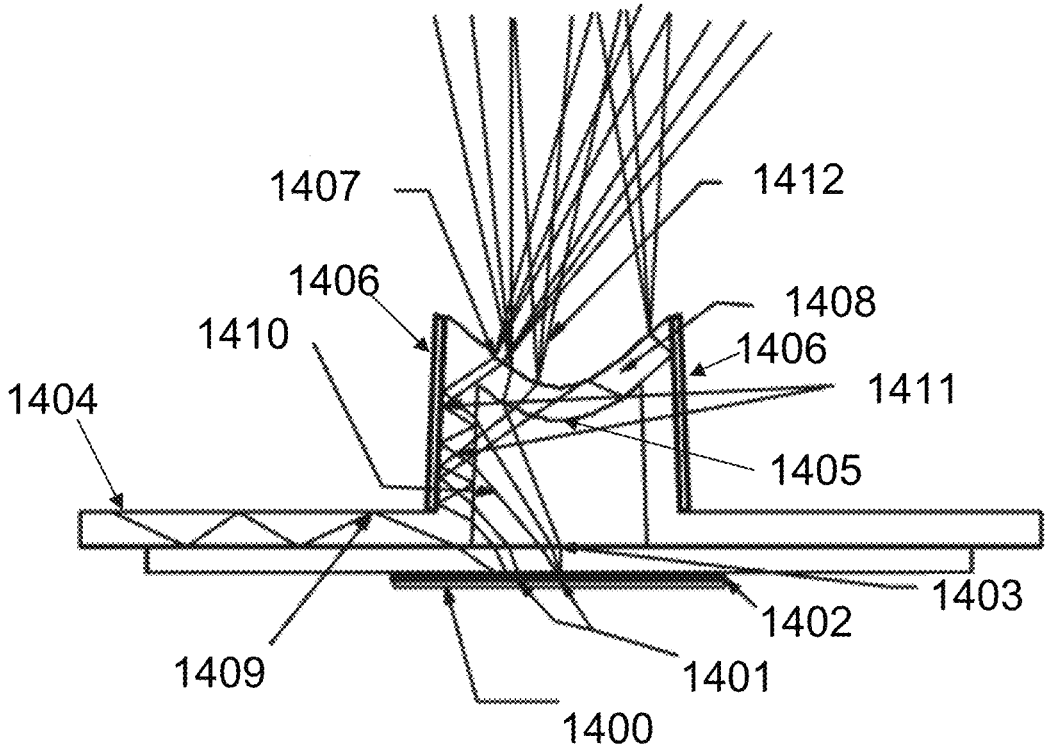
FIG. 14 illustrates an exemplary raytrace of elements of the lighting system and traces paths of light generated from LED mini chip sources in an example embodiment of the present disclosure
Figure 16:
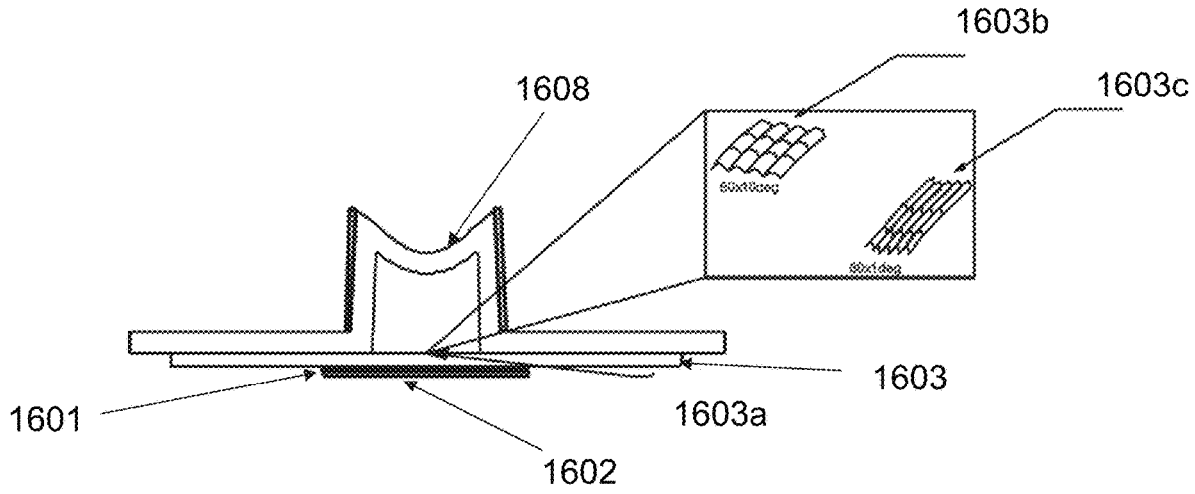
FIG. 16 illustrates an example embodiment of an elliptical diffuser located above an LED chip source array by a 0.5 mm air gap.
Figure 17:
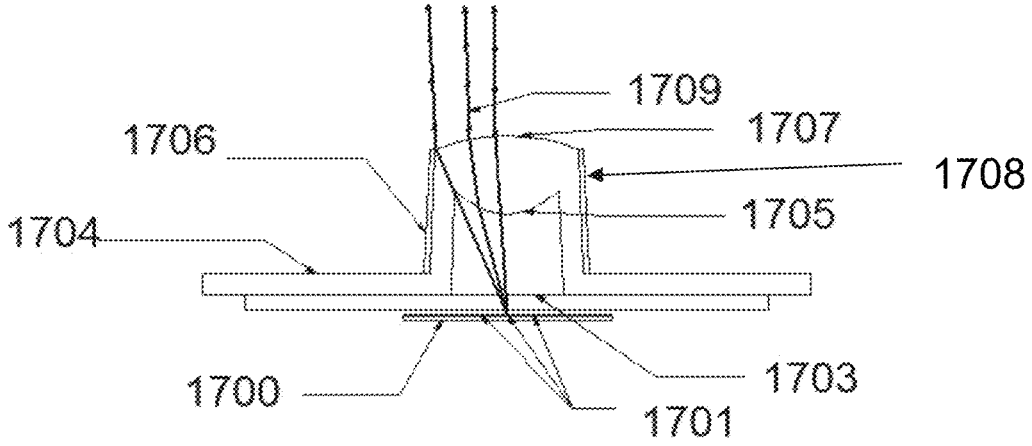
FIG. 17 illustrates an exemplary raytrace of a mini-chip LED optical system constructed in accordance with an example embodiment.

FIG. 14 illustrates a raytrace of elements of the lighting system of FIG. 13, and traces the important paths of light as they generate from the LED mini chip sources 1301 through the system shown in FIG. 13. Elements shown in FIG. 13 that are shown in FIGS. 14, 16 and 17 are numbered using similar nomenclature (e.g., element 1301 in FIG. 13 is element 1401 in FIG. 14, element 1601 in FIG. 16, and element 1701 in FIG. 17, and so on). The elements shown in FIG. 14 are an LED PCB 1400 which electrifies the mini chip light sources 1401. Silicone coating 1402 is provided, through which light first passes to the elliptical diffuser 1403. Rays of light 1409 represents the rays of light reflecting or absorbing from the flat surfaces 1404 of the optical lens 1408. The ray bundles 1410 represent light entering the optical lens 1408. Light incident from light sources 1401 may be recycled and redirected light 1411 represents rays redirected by the side wall mirrors 1406 which through redirection can pass through the optical element 1408 to the outside. Rays exiting 1412 the concave optic 1407 are scattered by micro-texture on the outside 1407 of the optical lens 1408.

To account for the minimized x-pitch, y-pitch, and z-distance, the present disclosure utilizes an improved elliptical diffuser 1600.

FIG. 16 illustrates an example embodiment of an improved elliptical diffuser 1603 located above the LED chip source array 1601 which is bonded to a flexible PCB 1602 and spaced from the diffuser 1603 by a 0.5 mm air gap. The microstructure facing outwards from the diffuser surface 1603 may be comprised of different aspect ratio micro elliptical elements 1603*b* and 1603*c* in the micron feature range of approximately 2-50 μm and of varying aspect ratio of approximately 1:2-1:10.

The 1603*b* microstructure represents a 60×10 deg micro diffuser lens feature, and 1603*c* microstructure represents a more aggressive aspect ratio of microstructure which can produce 80×1 deg ellipticity. The soft diffusion direction of the microstructure 1603*b* only spreads the beam by 1-20 deg. The more aggressive lenslets of microstructure 1603*c* diffuse in the transverse direction 30-80 deg.

To avoid imaging caustics which may result, the elliptical micro-lenslet structure of the diffuser 1603 can be interspersed by symmetrically diffusing but randomly varied height lenslet features. These features can be holographically etched by a 355 nm femtosecond laser pulse onto a mandrel or form tool, or, using imprint lithography, a cloning tool may be used to imprint or emboss the microstructures onto a thin layer of silicone approximately 10-125 μm in thickness.

Diffuser angle refers to how the diffuser 1603 operates upon the incoming light fields. The net effect on the light is a convolution of incoming light distribution and the additional spreading function provided by the diffuser 1603. Diffuser (deg) and resulting illuminance (lux) are shown in Table 3 below (an in FIG. 8) and in FIG. 9.

For example, if a collimated beam with <1 deg divergence angle were to strike a 5 deg diffuser 1603, then the net beam distribution would be approximately the root of the sum of the squares of the incoming beam distribution and the diffuser operator 5 deg in this case. For wider beam distributions >60 deg, the effect of diffusion is approximately additive. For example, if the incoming beam distribution were 120 deg, and a 30 deg diffuser 1603 were applied with micro-diffusion structure facing away from the light source, then the net distribution angle after scattering would be approximately 150 deg.

TABLE 3

| Diffuser (deg) | Illuminance (lux) |
|---|---|
| 5 | 50909 |
| 30 | 45479 |
| 80 | 41387 |

FIG. 17 illustrates one example of a raytrace of a mini-chip LED optical system in which micro or mini chip LED's 1701 produce solid state light through electrification and thermal dissipation through PCB 1700.

The light emerging from the LED 1701 passes through an air gap 1710 before diffusion by diffuser 1703, e.g., which may include elliptical micro optical elements (e.g., 1603*b* and 1603*c* shown in FIG. 16). Optical element flat segments 1703 can reflect or absorb light preserving the definition of the light emerging through optical element 1705. Although the optical element 1705 is shown having convex shape, the shape may also be concave, rippled, or free-form shaped.

As shown with convex light shaping, the light rays incident are focused and emerge through second convex shape element 1707 (e.g., exiting the optical control element) more collimated than before. Higher collimated light 1709 produces higher luminous intensity and throw.

Light throw refers to light which can produce higher illuminance at a 30 m distance than a light with wider distribution angle.

The exiting optical control element 1707 can include prismatic elements, e.g., to disperse light with nonlinear light distribution. Light emerging from lateral LEDs 1701 may be reflected and recycled by means of reflector element 1706, which may be positioned on both the right and left sides of the secondary optic 1707.

Figure 15:
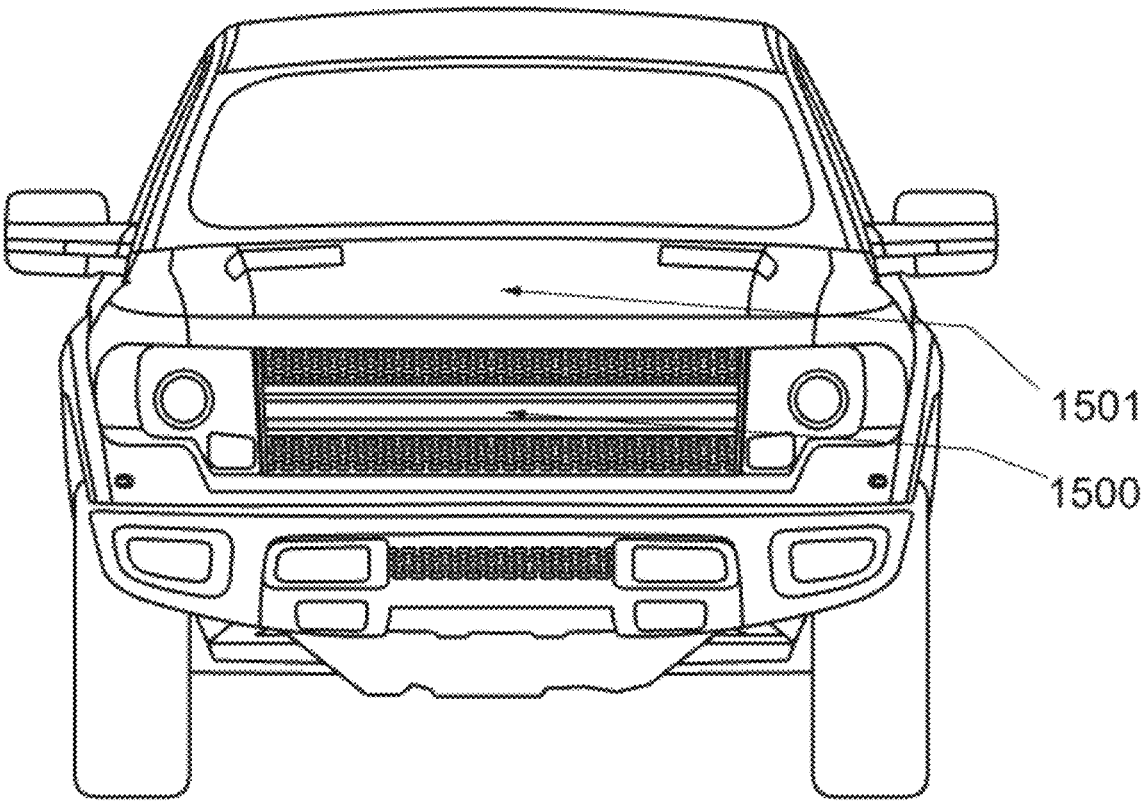
FIG. 15 illustrates an exemplary installed embodiment of the present disclosure.

FIG. 15 illustrates an example of an installed embodiment of the disclosure. In this example, electric truck vehicle 1501 includes a lit grille optical system 1500 enhanced with increased optical efficiency and weight savings.

Figure 18:
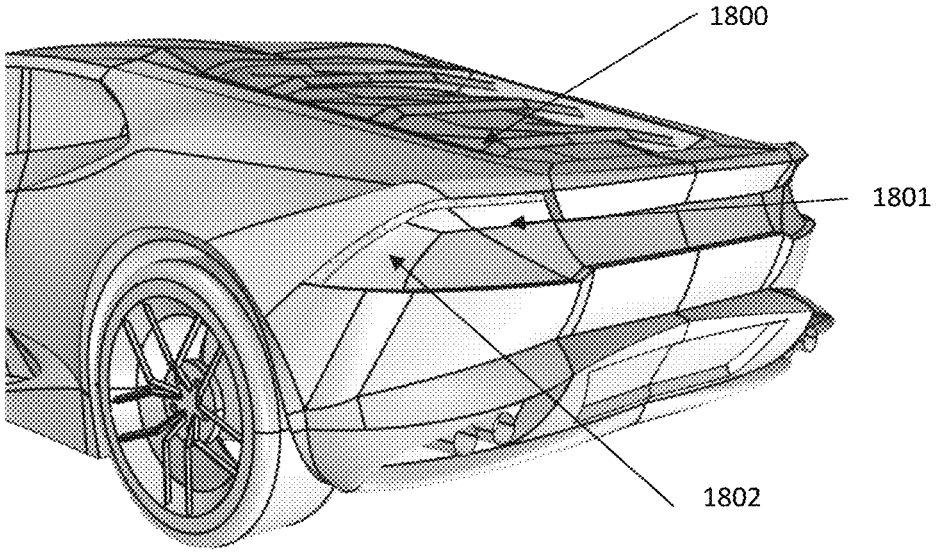
FIGS. 18 and 19 illustrates respective exemplary installed embodiments of the present disclosure.

FIG. 18 illustrates that the LED-based lighting assembly of the example embodiments is not limited to lit front grill products, and can be applied to a vehicle 1800 in which the rear tail light or rear combination lamp (RCL) 1801 comprises a thin profile optical system 1802 constructed in accordance with aspect of the example embodiments and which includes parts described in previous FIGS. 13-17. The advantage of using the thin profile optical system 1802 with enhanced efficiency >40% is that both uniformity >80% and animation can be achieved. Typically these constraints run counter to each other. A high efficiency system usually has poor uniformity when using large packaged LEDs as described in connection with FIGS. 1-3, for example, as the power through each element is high and the light emitting elements are separated by 10-25 mm. In other cases, a high power LED>10 W injects light into a free-form light guide element with prismatic lenses to disperse the light uniformly. The disadvantage of light guide solutions is that no animation is possible but rather only dimming of the light or flashing for turn signal. As shown in FIG. 18, however, the optical element (e.g., vehicle lamp 1801) can be constructed very thin (e.g., on the order of <20 mm, and even 2 mm is possible) with Red and Amber mini-chips on the scale of 100 μm. Micro-LED chips of a scale of 50 and 25 μm are also possible with proper PCB elements which reduce stress on the solder joints and copper traces used to electrify the LED chips.

Figure 19:
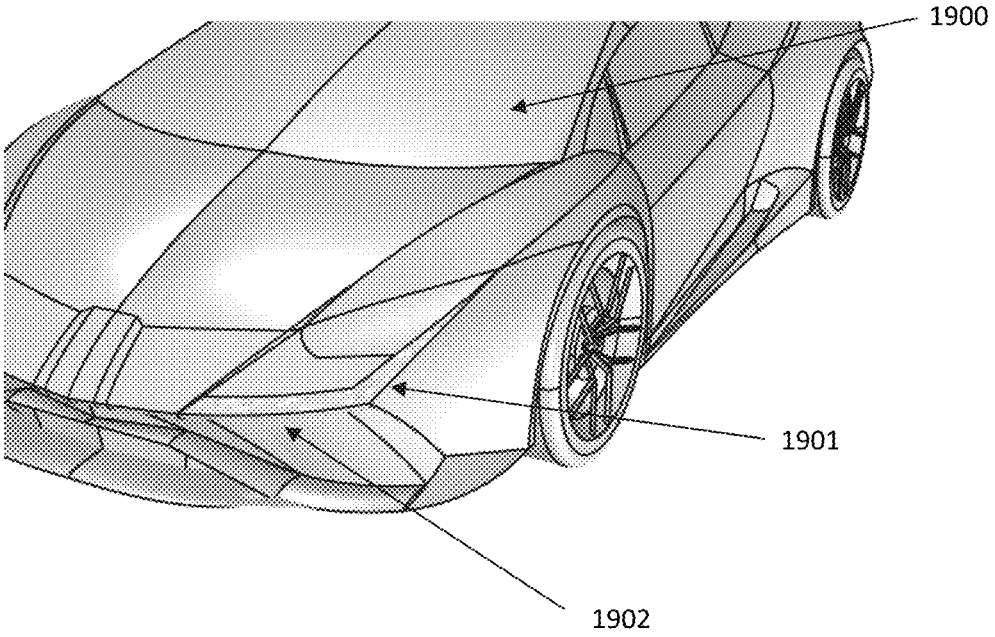

FIG. 19 illustrates the application of the optical system disclosed above to the day time running lamps (DRL) 1901 of the front lighting of a vehicle 1900 usually located in the corners near the forward facing head lamps. Either Amber or White is typically used in automotive lighting today. The optical system 1902 with elements comprising a flexible PCB and silicone optics constructed in accordance with aspect of the example embodiments can enable the flexing or bending of the system 1902 around curves of the vehicle in one or two directions. The advantage over large packaged LED solutions is that both high uniformity and animation effects can be made possible by the example embodiments which employ a mini-chip solution comprised, for example, of phosphor converted LEDs of size down to 100 μm. By placing many LEDs (e.g., 1301, 1601, 1701) in either one dimensional (1-D) or two dimensional (2-D) patterns or in 2-D pictograms with animation, lighting functions both for safety and informational or communication purposes are achieved in accordance with the example embodiments. Each LED can be comprised of one or two colors. The daytime running lamp can, for example, operate continually in both daytime and nighttime, and switch off when applying a turn signal function utilizing the same optical system 1902 constructed in accordance with example embodiments of the present disclosure.

Applications of embodiments in the present disclosure could be applied in numerous applications and industries. For example, as noted above, the present disclosure could be used in automotive grills or other emblems. This would also be advantageous in other transportation industries such as unmanned vehicles, drones, hoverboards, mopeds, bicycles, motorcycles, or other mobile apparatuses. Embodiments of the present disclosure use high-volume micro and mini-LEDs (e.g., 1301, 1601) which can be applied to any surface with microscopic accuracy and such surface can be curved, for example. The diffuser (e.g., 1303, 1603) and optic (1308, 1608) can be similarly curved, depending on application, for an advantageous range of applications for exterior and interior lighting. For example, embodiments of the present disclosure can be provided as part of front and/or rear vehicle lighting modules and controlled for different functions chosen from, but not limited to, brake lights, turn signals, daytime running lights, head lights, tail lights, front and rear fog lights and other lights provided via front and/or rear vehicle lighting modules. Embodiments of the present disclosure can also be used for interior lighting applications such as dashboard indicators, interior lighting (e.g. dome and door lights) and decorative, stylized lighting along contours of vehicle seats, door panels, consoles, and other interior vehicle surfaces.

Similarly, the present disclosure would be advantageous in any device requiring lit branding or safety notifications, protocols or messaging. For example, store fronts, houses, billboards, or any marketing surface can have an improved LED-based lighting assembly in accordance with the technical solutions provided by the example embodiments.

The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the present disclosure. In some example embodiments, well-known processes, well-known device structures, and well-known technologies are not described in detail, as they will be readily understood by the skilled artisan in view of the disclosure herein.

The foregoing description of the embodiments has been provided for purposes of illustration and description. It is not intended to be exhaustive or to limit the disclosure. Individual elements, assemblies/subassemblies, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

The preceding description of the disclosed embodiments is provided to enable any person skilled in the art to make or use the present subject matter. Various modifications to these embodiments will be readily apparent to those skilled in the art, and the generic principles defined herein may be applied to other embodiments without departing from the spirit or scope of the subject matter. Thus, the present subject matter is not intended to be limited to the embodiments shown herein but is to be accorded the widest scope consistent with the following claims and the principles and novel features disclosed herein.

While various aspects and embodiments have been disclosed, other aspects and embodiments are contemplated. The various aspects and embodiments disclosed are for purposes of illustration and are not intended to be limiting, with the true scope and spirit being indicated by the following claims.

The invention claimed is:

1. A light emitting diode (LED)-based lighting assembly comprising:

a light source comprising a plurality of LED chips chosen from mini-chip LEDs and microchip LEDs, wherein an x-direction corresponds to a length of a LED chip, a y-direction corresponds to a width of a LED chip, and a z-direction corresponds to a vertical distance from a LED chip, wherein pitch corresponds to a chip-to-chip distance between two LED chips in one of the x-direction and the y-direction;

a diffuser having a diffuser input surface to receive light from the light source and a diffuser output surface to transform received light, the diffuser input surface disposed a selected distance in the z-direction from light output surfaces of the plurality of LED chips, wherein a less than one-to-one (1:1) ratio exists between the selected pitch and the selected z-direction; and an optic system arranged to receive light from the diffuser output surface and comprising:

an optical element with a convex or a concave shape, the optical element including an optic input surface positioned a first distance from the light source in the z-direction and extending a first width in the x-direction and an optic output surface positioned a second distance from the light source in the z-direction and extending a second width in the x-direction, the second distance being greater than the first distance and the second width being greater than the first width; and a reflector element arranged to reflect and recycle received light, the reflector element extending above and below the optic input surface and the optic output surface in the z-direction, wherein the diffuser extends outwardly of the reflector element in the x-direction.

2. The LED-based lighting assembly of claim 1, wherein light output from the light source passes through an air gap before impinging on the diffuser input surface.

3. The LED-based lighting assembly of claim 1, wherein the optical element has a convex shaped lens input surface and a convex-shaped lens output surface.

4. The LED-based lighting assembly of claim 1, wherein the diffuser is an elliptical diffuser.

5. The LED-based lighting assembly of claim 4, wherein the diffuser output surface comprises a plurality of micro-elliptical elements having different aspect ratios.

6. The LED-based lighting assembly of claim 4, wherein the diffuser output surface comprises a plurality of lenslet features of varying heights.

7. The LED-based lighting assembly of claim 4, wherein the diffuser output surface comprises microstructures having varying features provided onto a silicone material.

8. The LED-based lighting assembly of claim 1, wherein the light source comprises a printed circuit board connected to the LED chips to power and control the LEDs, and a silicone coating on at least the light output surfaces of the LED chips.

9. The LED-based lighting assembly of claim 1, wherein the light source, the diffuser, and the optic system are flexible and curved.

10. The LED-based lighting assembly of claim 1, wherein the optic element is raised relative to a planar area and the optic system comprises a wall that encloses an optic input surface of the optical element, and the reflector element is disposed adjacent the wall to redirect light output from the diffuser toward the optic input surface.

11. The LED-based lighting assembly of claim 1, wherein the reflector element is separated from the diffuser output surface by a pair of flat surface portions of the optical element extending outwardly in the x-direction of the optic input surface and the optic output surface.

12. A method of making a light emitting diode (LED)-based lighting assembly comprising:

arranging a light source comprising a plurality of LED chips chosen from mini-chip LEDs and micro-chip LEDs to create a selected pattern from the LED chips, wherein an x-direction corresponds to a length of a LED chip, a y-direction corresponds to a width of a LED chip, and a z-direction corresponds to a vertical distance from a LED chip, wherein pitch corresponds to a chip-to-chip distance between two LED chips in one of their x-direction and their y-direction, and wherein the plurality of LED chips are arranged at a selected pitch for a designated lighting effect from the selected pattern;

electrically coupling the light source to a printed circuit board to power and control the LEDs;

disposing a diffuser a selected distance relative to the light source, the diffuser having a diffuser input surface to receive light from the light source and a diffuser output surface to emit received light, a diffuser output surface having an elliptical diffuser portion; and coupling an optic system to the diffuser output surface to define a gap between the optic system and the diffuser outer surface with the elliptical diffuser portion encapsulated within the gap, the optic system configured to receive light from the diffuser, the optic system having an optical element with a convex shape and a reflector element to reflect and recycle received light from the diffuser toward an optic input surface of the optical element.

13. The method of making the LED-based lighting assembly of claim 12, further comprising providing a silicone coating on at least the light output surfaces of the LED chips.

14. The method of making the LED-based lighting assembly of claim 12, further comprising providing microstructures having varying features on the diffuser output surface.

15. The method of making the LED-based lighting assembly of claim 12, wherein the light source, the diffuser, and the optic system are flexible, and the selected pattern comprises a curve, and further comprising arranging the LED-based lighting assembly into the curved selected pattern.

16. The method of making the LED-based lighting assembly of claim 12, wherein the light source, the diffuser, and the optic system are flexible, and further comprising arranging the LED-based lighting assembly into a contoured shape that accommodates a selected mounting structure.

17. A light emitting diode (LED)-based lighting assembly comprising:

a light source comprising a plurality of LED chips chosen from mini-chip LEDs and microchip LEDs, wherein an x-direction corresponds to a length of a LED chip, a y-direction corresponds to a width of a LED chip, and a z-direction corresponds to a vertical distance from a LED chip, wherein pitch corresponds to a chip-to-chip distance between two LED chips in one of the x-direction and the y-direction;

a diffuser having a diffuser input surface to receive light from the light source and a diffuser output surface to transform received light; and an optic system arranged to receive light from the diffuser output surface and comprising:

an optical element including an optic input surface extending a first width in the x-direction and an optic output surface extending a second width in the x-direction, the second width being greater than the first surface; and a reflector element arranged to reflect and recycle received light, the reflector element extending above and below the optic input surface and separated by one another by a third distance, the third distance being greater than the second distance.

18. The LED-based lighting assembly of claim 17, wherein the diffuser output surface has an elliptical diffuser portion.

19. The LED-based lighting assembly of claim 18, wherein a gap is defined between the optic system and the diffuser outer surface with the elliptical diffuser portion encapsulated within the gap.

* * * * *